United States Patent [19]

France et al.

[11] 4,129,091

[45] Dec. 12, 1978

[54] IMPREGNATION APPARATUS HAVING BIAS-OPENING MEANS

[76] Inventors: James R. France, 3 Strine Way, Newport, Shropshire; John D. Buchan, Balshaw Fold, under Billinge La., Blackburn, Lancashire; Richard G. Tyrer, 10 North Dunes, Hightown, Liverpool, L38 OBJ, all of England; Adolf De Ceuleneer, Elisabethlaan, 88, 2600 Berchem, Antwerpen; Robert Van Steenkiste, Eric Jameslaan, 7, B.8370, Blankenberge, both of Belgium

[21] Appl. No.: 868,210

[22] Filed: Jan. 9, 1978

[30] Foreign Application Priority Data

Jan. 10, 1977 [GB] United Kingdom ..... 709/77
Nov. 11, 1977 [GB] United Kingdom ..... 47987/77

[51] Int. Cl.[2] ..... B05C 9/10; B05C 11/11

[52] U.S. Cl. ..... 118/50; 118/429; 220/437

[58] Field of Search ..... 427/296, 297, 298, 351, 427/356, 358, 294, 295; 118/50, 50.1; 220/435, 437; 190/41 Z; 150/51; 53/37; 105/367, 463

[56] References Cited

U.S. PATENT DOCUMENTS

| | | | |
|---|---|---|---|
| 899,480 | 9/1908 | Buehler | 427/298 |
| 2,394,853 | 2/1946 | Goddard | 220/437 X |
| 3,639,152 | 2/1972 | Page et al. | 118/50 X |
| 3,730,308 | 5/1973 | Pelavin | 190/41 Z |
| 3,731,828 | 5/1973 | Clarke et al. | 220/437 X |
| 3,895,138 | 7/1975 | Sewell et al. | 427/298 |
| 3,968,276 | 7/1976 | Allen | 427/297 |
| 4,007,706 | 2/1977 | Arvidsson | 427/294 X |
| 4,013,809 | 3/1977 | Marocco | 427/296 |
| 4,017,980 | 4/1977 | Kleinguenther | 427/297 X |
| 4,060,953 | 12/1977 | Milne | 427/297 X |

FOREIGN PATENT DOCUMENTS

| | | | |
|---|---|---|---|
| 498173 | 10/1919 | France | 220/15 |

*Primary Examiner*—Morris Kaplan
*Attorney, Agent, or Firm*—Buell, Blenko & Ziesenheim

[57] ABSTRACT

A body, or stack of bodies, made of timber or of other organic fluid-permeable material is impregnated with an impregnant by introducing the body or stack into a receptacle of fluid-impermeable material through an opening therein, the flexible receptacle being supported by and secured (e.g. by springs) to a substantially rigid structure in such a way that the receptacle is held open for the introduction through said opening of the body or stack. The opening in the receptacle is sealed to form a fluid-tight enclosure and air is evacuated from within the enclosure and from voids in the or each body housed therein to cause the flexible receptacle to collapse around the body or stack. Impregnant is allowed to enter the evacuated enclosure and to flow through and impregnate the or each body.

12 Claims, 8 Drawing Figures

Figure 5:
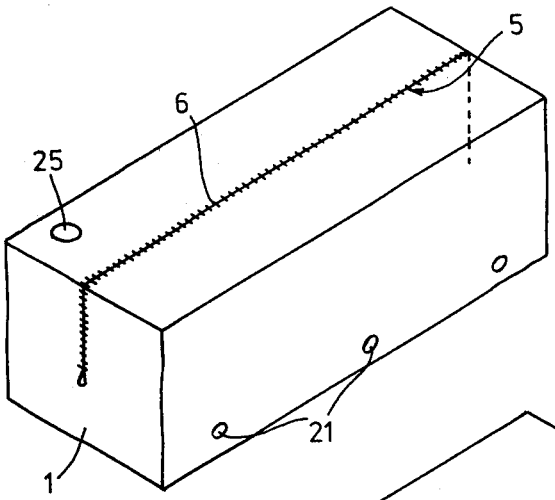

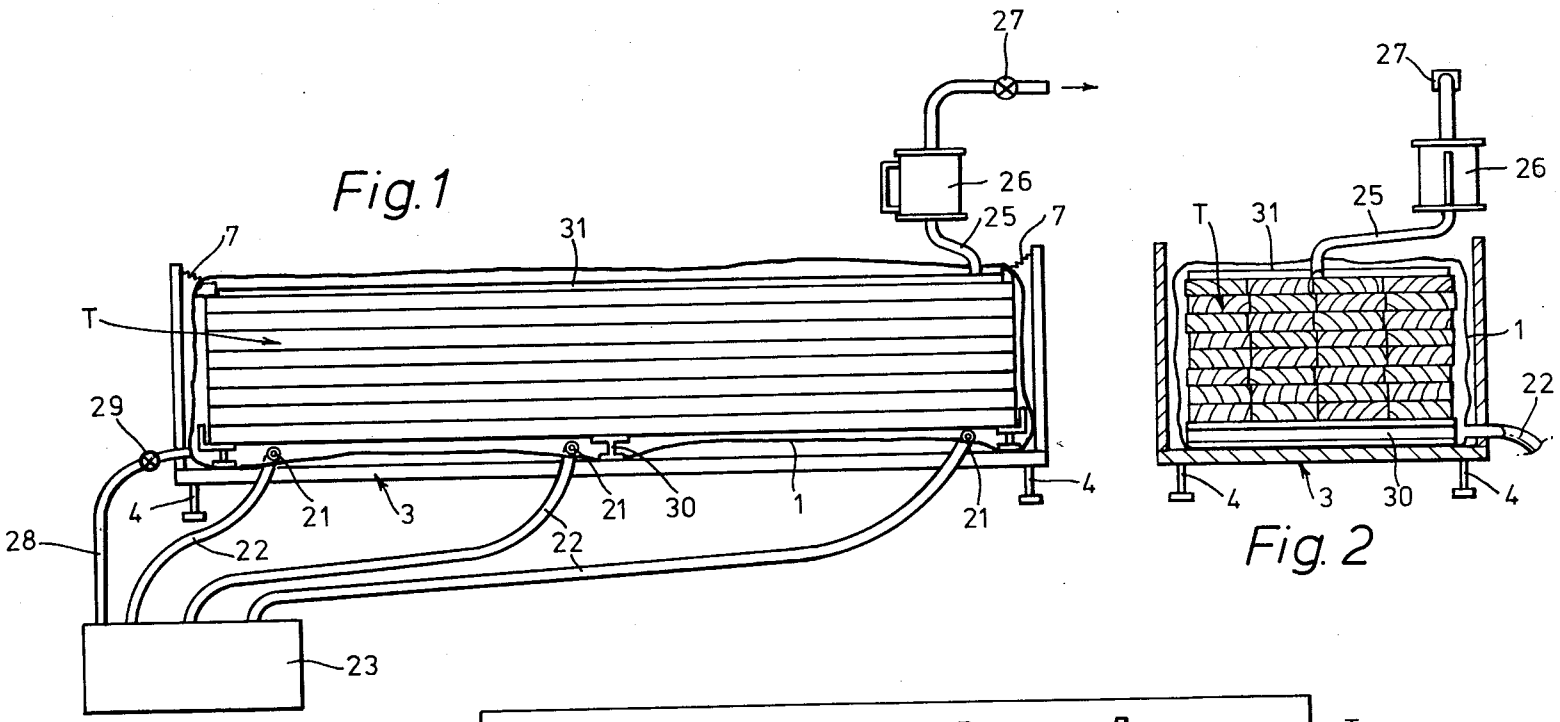
Fig. 2
Fig. 1
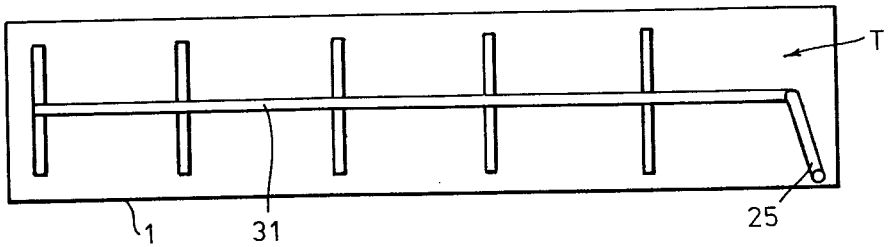
Fig. 3

Fig. 7
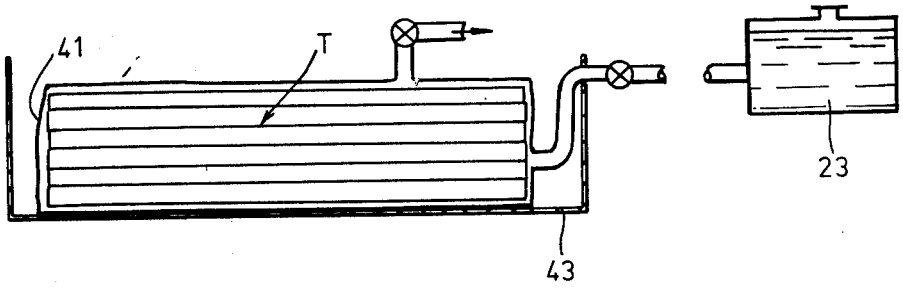
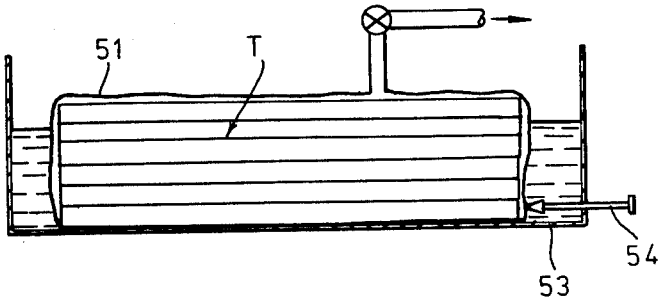
Fig. 8

IMPREGNATION APPARATUS HAVING BIAS-OPENING MEANS

This invention relates to impregnation with an impregnant in a liquid or semi-liquid state of a body or bodies made wholly or in part of organic fluid-permeable material.

It is often desirable that timber, wood or other organic fluid-permeable material of a body that is to be used in the fabrication or manufacture of a structure be pre-impregnated with an impregnant which will protect the organic fluid-permeable material against fire and/or biological attack, e.g. by termites, bacteria and fungus, and/or damage by weather or pollution.

It is an object of the present invention to provide an improved apparatus for impregnating with an impregnant in a liquid or semi-liquid state at least one body made wholly or in part of organic fluid-permeable material.

According to the invention, apparatus is provided for introducing said body or a plurality of said bodies into a receptacle of flexible fluid-impermeable material through an opening therein, the flexible receptacle being supported by and secured to a substantially rigid structure in such a way that the receptacle is held open for the introduction through said opening of said body or plurality of bodies; sealing the opening in the receptacle to form a substantially fluid-tight enclosure; evacuating air and any other fluid from within the fluid-tight enclosure so formed and from voids in the or each body housed therein to cause the flexible, fluid-impermeable material of the receptacle to collapse around the body or bodies; and allowing impregnant in a liquid or semi-liquid state to enter the fluid-tight enclosure and to flow through and impregnate the organic fluid-permeable material of the or each body.

The flexible receptacle may be temporarily secured to the rigid structure and detached from the rigid structure before the opening in the receptacle is sealed. Preferably, however, the flexible receptacle is secured to the rigid structure by extensible means in such a way that the receptacle is urged towards and held in the open position by the action of the said extensible means for the introduction through the opening of said body or plurality of bodies, boundary edges of said opening are secured together against the action of said extensible means to effect a substantially fluid-tight seal; and when the body or bodies is or are substantially fully impregnated, the boundary edges of said opening are disengaged to break the seal and permit said extensible means to urge the receptacle to and hold it in the open position for withdrawal of the impregnated body or bodies.

The impregnant may be allowed to enter the fluid-tight enclosure before or after the enclosure and voids in the or each body housed therein have been substantially evacuated.

Evacuation of air and any other fluid from within the fluid-tight enclosure is preferably effected through at least one outlet at or near an upper part of the receptacle by means of at least one vacuum pump and/or at least one air compressor with or without an associated venturi suction ejector, and introduction of impregnant in a liquid or semi-liquid state into the fluid-tight enclosure is preferably effected through at least one inlet at or near a lower part of the fluid-tight enclosure.

Where a plurality of bodies in the form of a stack is to be introduced into the fluid-tight enclosure, preferably the flexible receptacle is of a shape and size approximating to that of the stack and extensible means securing the receptacle to the rigid structure are also so arranged as to maintain the receptacle in said shape and size. Preferably, also, spacers are introduced between adjacent bodies of the stack to provide for flow of impregnant between the bodies.

The body or plurality of bodies may be supported in the flexible receptacle on mutually spaced, substantially rigid members which space the body or plurality of bodies from the base of the receptacle to provide for flow of impregnant beneath the body or plurality of bodies.

To provide for draining of the receptacle and to enable impregnant to be introduced at a lower part of the flexible receptacle, preferably the rigid structure is so arranged that the base of the flexible receptacle is inclined at an acute angle to the horizontal, for example an angle lying in the range 1:15 to 1:25.

Preferably, the rigid structure and flexible receptacle supported by and secured to the structure may be so arranged that the opening in the receptacle is in the top wall of the receptacle and the body or plurality of bodies is lowered downwardly into the receptacle, but in some circumstances the opening in the receptacle may be in a side or end wall of the receptacle and the body or plurality of bodies introduced laterally into the receptacle, for instance by means of a conveyor or along rollers. In this latter case, the impregnant is drained from the receptacle before the impregnated body or bodies is or are removed.

Where the rigid structure is a tank or other rigid container, impregnant in a liquid or semi-liquid state may be introduced into the tank and, after the fluid-tight enclosure has been evacuated, the receptacle punctured in at least one position to allow impregnant to flow from the tank into the receptacle. An adjustable tool for puncturing the receptacle may be mounted in the base or a side wall of the tank and may be operable from outside the tank.

In all cases, evacuation of air and other fluid from the flexible receptacle and/or introduction of impregnant into the receptacle may be automatically controlled to maintain a substantially constant head of impregnant in the receptacle during impregnation.

The impregnant is preferably a liquid or semi-liquid preservative and/or fire-resistant material which soaks into and impregnates the organic fluid-permeable material of the or each body but, in some circumstances, the impregnant may be a hardenable material which will fill voids in the material and, after being permitted or caused to set, will adhere to the surfaces of the material bounding the voids. Suitable hardenable materials include water-resistant resins such as polyester resins and epoxy resins.

The invention also includes apparatus for use in impregnating with an impregnant in a liquid or semi-liquid state at least one body made wholly or in part of organic fluid-permeable material, which apparatus comprises a substantially rigid support structure; a receptacle of flexible fluid-impermeable material supported by the rigid structure, which receptacle has an opening for introduction into the receptacle of said body or a plurality of said bodies, means securing the receptacle to the rigid structure in such a way that the receptacle is held open for introduction through said opening of said body or plurality of bodies, and means for sealing said opening; at least one outlet in the receptacle through which air and any other fluid can be evacuated from within the receptacle; and at least one inlet in the receptacle through which impregnant in a liquid or semi-liquid state can be introduced into the receptacle.

Preferably, the receptacle includes extensible means securing the receptacle to the rigid structure and urging the receptacle into the open position and means for securing boundary edges of said opening together against the action of said extensible means to effect a substantially fluid-tight seal.

Preferably the substantially rigid structure supporting the flexible receptacle is a pallet comprising a base and an upstanding peripheral wall or a plurality of separate upstanding walls or upright members spaced around the periphery of the base and, in this case said extensible means secure a part or parts of the receptacle bounding said opening to said peripheral wall or to said separate upstanding walls or upright members. The wall or walls of the pallet may be of solid form for example, the pallet may be a tank or other rigid container, but, preferably, the pallet is in the form of a light framework, for example a framework of a substantially rectangular form with side and end walls of plastics coated wire mesh.

To provide for the rigid structure so supporting the flexible receptacle that the base of the receptacle is inclined at an acute angle to the horizontal, the structure may be provided with adjustable feet. In addition, to enable the rigid structure to accommodate flexible receptacles of any one of a limited number of different sizes, where the structure is of substantially rectangular form the distance between one or each pair of opposite walls may be adjustable.

The flexible receptacle may be formed wholly or in part of a transparent material so that progress of the impregnation process can be observed. Receptacles made from flexible transparent polyethylene sheet are especially suitable; other suitable flexible materials include butyl rubber sheet. In all cases the receptacle may be strengthened by a detachable internal or external layer of netting or mesh of suitable flexible reinforcing material.

As previously indicated evacuation of the receptacle and/or introduction of the impregnant may be automatically controlled and suitable control means may be secured to the outer surface of a wall of the rigid structure.

Figure 6:
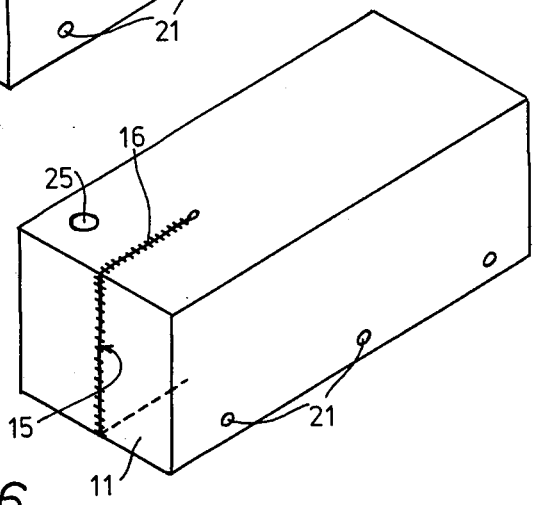
Figure 4:
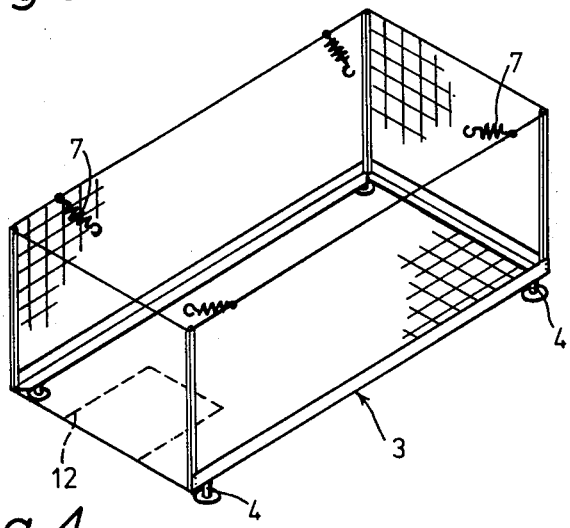

The invention will be further illustrated by a description, by way of example, of a preferred method of and apparatus for impregnating with an impregnant in a liquid state a stack of timber elongate members and of two alternate methods and apparatus, with reference to the accompanying drawings, in which:

FIGS. 1, 2 and 3, respectively, are diagrammatic side and end cross-sectional views and a fragmental view from above of the preferred apparatus;

FIG. 4 is a perspective view of the preferred form of substantially rigid structure used in the apparatus shown in FIGS. 1 to 3;

FIGS. 5 and 6, respectively, are perspective views of two forms of flexible receptacle used in conjunction with the rigid structure shown in FIG. 4, and FIGS. 7 and 8, respectively, are diagrammatic illustrations of the apparatus employed in the aforesaid alternative methods.

Referring to FIGS. 1 to 6, the preferred apparatus comprises a flexible receptacle 1 supported in and secured to a substantially rigid pallet 3 which, as will be seen on referring to FIG. 4, is a framework of rectangular form made of plastics-covered weld mesh and supported on the ground by vertically adjustable feet 4.

The flexible receptacle 1 is in the form of a preformed container of rectangular form which is made of butyl rubber and which has an opening, closable by an airtight zip, for introduction of a star of timber. Where it is required to load and unload the receptacle 1 from above, as will be seen in FIG. 5 the receptacle has an opening 5, closable by a zip 6, which extends lengthwise across the top of the receptacle and partly down each end wall; loading and unloading of this receptacle can be effected using a crane and/or a fork-lift truck. In this case, when the receptacle 1 is supported in the pallet 3, boundary edges of the opening 5 are secured to the pallet by springs 7 which urge the receptacle towards and hold it in the open position; the receptacle is also detachably secured to the pallet by means (not shown) at spaced positions around the lower part of the receptacle.

Where it is required to load and unload the receptacle laterally, as will be seen in FIG. 6 the receptacle 11 has an opening 15, closable by a zip 16, which extends down one end wall of the receptacle and partly along the top and base of the receptacle; loading and unloading of the receptacle 11 can be effected using a conveyor or a fork-lift truck or manually. In this case, the pallet 3 shown in FIG. 4 is modified by removing one end wall and a portion 12 in the base of the pallet and, when the receptacle 11 is supported in the pallet, boundary edges of the opening 15 are secured to the pallet by springs (not shown) which urge the receptacle towards and hold it in the open position.

Although, in FIG. 5, the zip 6 is shown extending lengthwise across the top of the receptacle and, in FIG. 6, the zip 16 is shown extending down one end wall of the receptacle, the zips need not necessarily be in these positions. For example, the top of the receptacle shown in FIG. 5 may be in the form of a "lid" which is detachably secured to the receptacle by a zip which extends around the upper part of one side wall and two end walls of the receptacle so that the "lid" is effectively "hinged" to the receptacle along the other side wall and can be held in the open position by appropriately positioned springs. Likewise, one end wall of the receptacle shown in FIG. 6 may be in the form of a "door" which is detachably secured to the receptacle by a zip which extends across the top and bottom and one side wall of the receptacle near the end wall so that the "door" is effectively hinged to the receptacle along the other side wall and can be held in the open position by appropriately positioned springs.

As will be seen in FIG. 1, the receptacle 1 has, near its base, three inlets 21 which are connected to a source 23 of liquid impregnant by pipes 22 and, in an upper part of the receptacle, an outlet 25 connected to a vacuum pump (not shown) via a surge tank 26 and valve 27.

At the lowermost part of the receptacle 1 is a drainage pipe 28 which extends to the source 23 and in which is connected a valve 29.

In employing the apparatus shown in FIGS. 1 to 5 to impregnate a stack T of timber elongate members, the receptacle is supported in the pallet 3 with its opening 5 urged into the open position by springs 7 and the stack, with spacers (not shown) introduced between adjacent members, is lowered into the receptacle to rest on rigid supports 30 which space the stack from the base of the receptacle. A tubular air-extraction spine 31, having a plurality of inlet orifices, is connected to the outlet 25 and is supported on the stack T. The zip fastener 6 is then closed against the action of the springs 7 to effect a substantially fluid-tight seal and so form a substantially fluid-tight enclosure. The vacuum pump is now brought into operation to evacuate air and any other fluid from within the sealed receptacle 1 and from voids in each timber member to cause the flexible material of the receptacle to collapse around the stack T. all air and other fluid has been substantially evacuated, impregnant in a liquid state from the source 23 is allowed to enter the receptacle 1 via the pipes 22 and inlets 21 and to flow through and impregnate the timber of each member. During this impregnation step, the level of impregnant in the surge tank 26 is maintained substantially constant by appropriate adjustment of the vacuum pump. When the timber members are substantially fully impregnated, the vacuum pump is switched off, excess impregnate is allowed to flow back into the source 23 by opening the valve 29, and the zip fastener 6 is released to permit the springs 7 to urge the receptacle 1 towards and hold it in the open position. The air-extraction spine 31 is then removed and the stack T of impregnated timber members is withdrawn upwardly from the receptacle 1.d.

The alternative form of apparatus shown in FIG. 7 differs from that shown in FIGS. 1 to 4 that the rigid structure is a tank 43 and in that the flexible receptacle 41 is temporarily secured in the tank and is detached from the tank after a stack T of timber has been loaded in the receptacle and before the opening in the receptacle is sealed. Impregnation of the timber is effected in a manner similar to that described with reference to FIGS. 1 to 3.

The second alternative form of apparatus shown in FIG. 8 differs from that shown in FIG. 7 in that the tank 53 itself serves as the source of liquid impregnant and in that an adjustable tool 54 for puncturing the receptacle 51 supported in the tank is mounted in a side wall of the tank and is operable from outside the tank. After the receptacle 51 has been evacuated, the tool 54 is actuated to puncture the receptacle to permit liquid impregnant to be sucked from the tank 53 into the receptacle to impregnante the stack T of timber. In all respects, the impregnation steps closely follow those described with reference to FIGS. 1 to 3.

The apparatus of the present invention is especially but not exclusively, suitable for impregnating with impregnant lengths of timber that are to be employed in the fabrication of buildings and that must be protected against fire and/or biological attack and/or damage by weather or pollution.

What we claim as our invention is:

1. Apparatus for use in impregnating with an impregnant in a liquid or semi-liquid state at least one body made at least in part of organic fluid-permeable material comprising a substantially rigid support structure; a receptacle of flexible fluid-impermeable material supported by the rigid structure, which receptacle has an opening for introduction into the receptacle of said body or bodies, extensible means securing the receptacle to the rigid structure and urging the receptacle opening into the open position for introduction through said opening of said body or bodies, said receptacle including integral means for securing boundary edges of said opening together against the action of said extensible means to effect a substantially fluid-tight seal; at least one outlet in the receptacle through which air and any other fluid can be evacuated from within the receptacle; and at least one inlet in the receptacle through which impregnant in a liquid or semi-liquid state can be introduced in to the receptacle.

2. Apparatus as claimed in claim 1, wherein said extensible securing means comprises a plurality of springs at spaced positions around that wall of the receptacle in which the opening is formed and also at other spaced positions around the receptacle.

3. Apparatus as claimed in claim 1, wherein the rigid structure is a pallet comprising a base and an upstanding peripheral wall.

4. Apparatus as claimed in claim 1, wherein the rigid structure is of substantially rectangular form and the distance between at least one pair of opposite walls is adjustable.

5. Apparatus as claimed in claim 1, wherein the substantially rigid support structure is a rigid container.

6. Apparatus as claimed in claim 1, wherein the rigid structure is provided with adjustable feet to provide for the rigid structure so supporting the flexible receptacle that the base of the receptacle is inclined at an acute angle to the horizontal.

7. Apparatus as claimed in claim 1, wherein the or each outlet is positioned in an upper part of the receptacle and the or each inlet is positioned in a lower part of the receptacle.

8. Apparatus as claimed in claim 1, wherein the outlet or at least one of the outlets has interconnected therein means for providing a visible indiction of the level of impregnant and rate of absorption.

9. Apparatus as claimed in claim 1, wherein the opening in the flexible receptacle is in a side or end wall.

10. Apparatus as claimed in claim 1, wherein the means for sealing said opening in the flexible receptacle is at least one airtight zip fastener.

11. Apparatus as claimed in claim 1, wherein the flexible fluid-impermeable material of the receptacle is transparent.

12. Apparatus for use in impregnating with an impregnant in a liquid or semi-liquid state at least one body made at least in part of organic fluid-permeable material comprising a tank; a receptacle of flexible fluid-impermeable material supported in the tank, which receptacle has an opening for introduction into the receptacle of said at least one body, extensible means securing the receptacle to said tank and biasing said opening to an open position for introduction through said opening of said at least one body, means integral with said receptacle and operative against said bias for extending said securing means and drawing together the boundary edges of said opening to effect sealing said opening; at least one outlet in the receptacle through which air and any other fluid can be evacuated from within the receptacle, mounted in the base or side wall of the tank, an adjustable tool for puncturing the receptacle, the tool being operable from outside the tank, and said impregnant being stored in the space between said receptacle and tank whereby said impregnant is admitted into the evacuated receptacle after puncture thereof.

* * * * *

UNITED STATES PATENT AND TRADEMARK OFFICE

CERTIFICATE OF CORRECTION

PATENT NO. : 4,129,091
DATED : December 12, 1978
INVENTOR(S) : James R. France, John D. Buchan, Richard G. Tyrer, Adolf De Ceuleneer and Robert Van Steenkiste It is certified that error appears in the above-identified patent and that said Letters Patent are hereby corrected as shown below:

Column 3, line 51, "alternate" should read --alternative--.

Claim 12, column 6, line 49, "of" should be deleted.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*